United States Patent [19]

Krigmont et al.

[11] Patent Number: 4,966,610

[45] Date of Patent: Oct. 30, 1990

[54] CONDITIONING OF GAS STREAMS CONTAINING PARTICULATE

[75] Inventors: Henry V. Krigmont, Seal Beach; Everett L. Coe, Jr., Downey, both of Calif.

[73] Assignee: Wahlco, Inc., Santa Ana, Calif.

[21] Appl. No.: 361,272

[22] Filed: Jun. 5, 1989

[51] Int. Cl.[5] ..... B03C 3/00

[52] U.S. Cl. ..... 55/5; 55/107

[58] Field of Search ..... 55/4,5,10,106,107,122; 361/226–228

[56] References Cited

U.S. PATENT DOCUMENTS

| | | | |
|---|---|---|---|
| 1,331,225 | 2/1920 | Wolcott | 55/5 |
| 2,525,347 | 10/1950 | Gilman | 55/10 |
| 3,503,704 | 3/1970 | Marks | 55/107 |
| 3,686,825 | 8/1972 | Busby | 55/5 |
| 3,993,429 | 11/1976 | Archer | 55/5 |
| 4,070,424 | 1/1978 | Olson et al. | 55/5 |
| 4,179,071 | 12/1979 | Kozacka | 239/559 |
| 4,333,746 | 6/1982 | Southam | 55/5 |
| 4,472,174 | 9/1984 | Chuan | 55/5 |

FOREIGN PATENT DOCUMENTS

| | | | |
|---|---|---|---|
| 114874 | 7/1979 | Japan | 55/5 |
| 421811 | 12/1934 | United Kingdom | 55/5 |

*Primary Examiner*—Bernard Nozick

*Attorney, Agent, or Firm*—Howard E. Sandler; Greg Garmong

[57] ABSTRACT

Effluent gas streams from power plants, or other sources, containing entrained particulate matter are conditioned by injecting a conditioning gas such as sulfur trioxide into the flowing gas stream. The conditioning gas is deposited upon the surface of the particulate and reduces its electrical resistivity, improving the performance of electrostatic precipitators through which the flowing gas is passed to precipitate the particulate. At the point of injection, an electrostatic potential is established between the particulate in the flowing gas stream and the conditioning gas molecules, so that the conditioning gas is attracted to the particulate. Interaction of the conditioning gas with the particulate is stronger and more rapid than in the absence of the electrostatic potential at the point of injection.

9 Claims, 1 Drawing Sheet

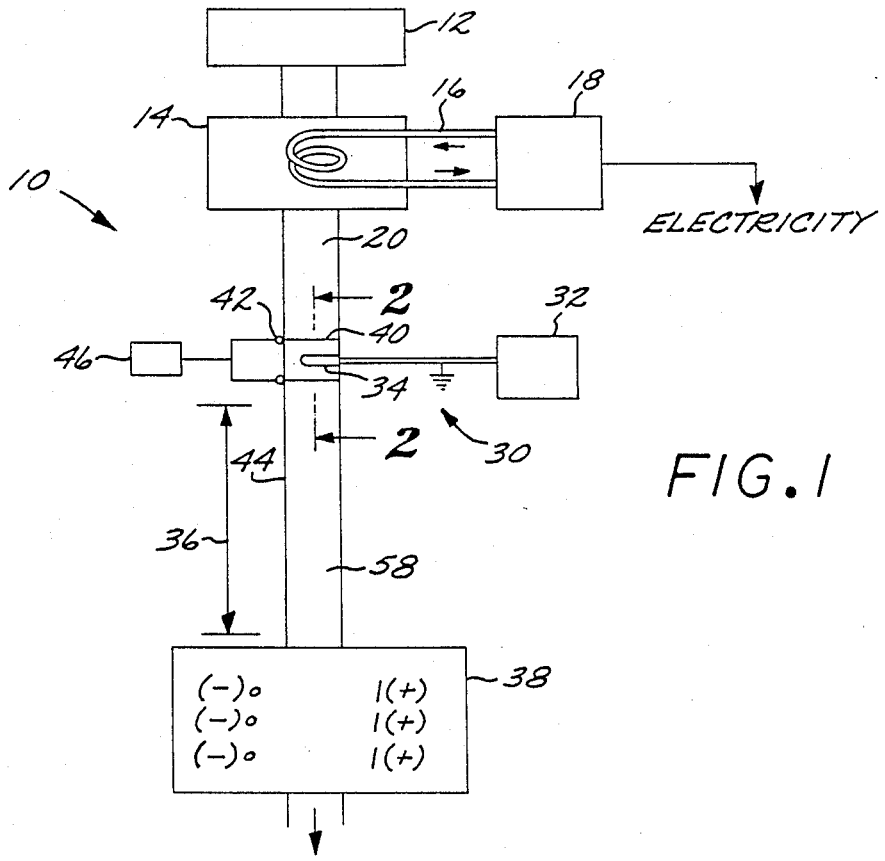
FIG. 1
FIG. 2
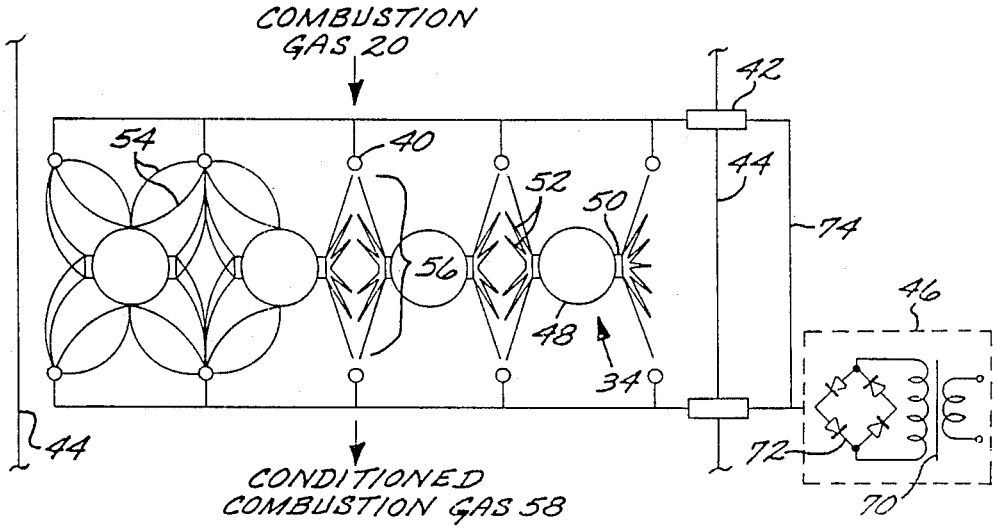

CONDITIONING OF GAS STREAMS CONTAINING PARTICULATE

BACKGROUND OF THE INVENTION

This invention relates generally to the cleaning of gas streams, and, more particularly, to the removal of solid particulate matter from the combustion gas stream of coal-fired power plants and other operations that produce particle-laden gas streams.

In a coal-fired power plant, coal is burned to heat air, which in turn boils water to form steam. The steam drives a turbine and thence an electric generator, producing electricity. Besides heat, the burning of the coal produces gaseous pollutants such as sulfur and nitrogen oxides, and a solid particulate known as fly ash. Environmental protection laws mandate that the amounts of gaseous pollutants and solid particulate emitted from the power plant be maintained at acceptably low levels, and the present invention deals generally with the technology for controlling particulate emissions.

One widely used approach for removing the particulate fly ash from combustion gas streams is electrostatic precipitation. The combustion gas stream with entrained particulate is passed between highly charged electrodes that ionize the particles so that they are deposited upon the collection electrodes. The particulate may optionally be charged prior to entry into the precipitator to increase the efficiency of removal. The cleaned combustion gases are released to the atmosphere, and the precipitated particulate is removed from the plates.

To control the sulfur levels in power plant emissions, coals containing low sulfur levels are sometimes burned. However, the particulate fly ash resulting from the burning of low-sulfur coal may be difficult to remove by electrostatic precipitation, because the electrical resistance of the particulate is too high for effective treatment. When high-sulfur coal is burned, sulfur trioxide naturally present in the particulate reacts with residual water to produce sulfuric acid that is deposited upon the surface of the particulate. The sulfuric acid produces ions which conduct electrical charge and reduce the surface electrical resistance of the particulate, permitting the use of the electrostatic precipitation treatment.

Since low-sulfur coal does not inherently produce sufficient sulfur trioxide to achieve the necessary electrical conductivity of the fly ash, it is sometimes necessary to add a controlled amount of sulfur trioxide to the combustion gas stream to condition the particulate so that it may be removed by electrostatic precipitation. The added sulfur trioxide reacts with water vapor in the gas stream to produce sulfuric acid, which is deposited upon the surface of the particulate. The amount of sulfur trioxide to be added is carefully controlled so that the cleaned combustion gas finally released to the atmosphere has a desirable balance of low sulfur content and low particulate content.

Several types of apparatus have been developed for controllably adding sulfur to condition the particulate of a flowing gas stream. One example of such an apparatus is that disclosed in U.S. Pat. No. 3,993,429. In the apparatus of that patent, sulfur is burned to a combustion product which is passed over a catalyst, and the resulting sulfur trioxide is injected into the flowing combustion gas stream in the correct proportion. This apparatus has been highly successful commercially, and is used in power plants throughout the United States and the world.

However, there are problems even with the sulfur trioxide-injection conditioning technology as presently practiced. First, the sulfur trioxide injection nozzles must be placed sufficiently far from the electrostatic precipitator that there is a retention time on the order of about one second between the point of injection of the sulfur trioxide into the flowing gas stream and the point that the stream enters the precipitator. This retention time permits the sulfur trioxide and water vapor to react and the resulting sulfuric acid to deposit upon the particulate. Since the combustion gas flow velocity is about 60 feet per second in a typical power plant, the sulfur injection nozzles must be about 60 feet from the precipitator, increasing the size of the plant and its capital cost.

Additionally, there are some types of low-sulfur coal that cannot be effectively conditioned by the known technology. An example is Australian Sydney Basin coal, which for a variety of reasons resists the deposition of sulfur trioxide and sulfuric acid onto its surface. The burning of such coals results in very low sulfur emission, but high levels of particulate.

There therefor exists a need for an improved combustion gas conditioning system that permits reduction in plant size, and increases the range of the types of coal that may be burned in power plants that have strict particulate emission standards. The present invention fulfills this need, and further provides related advantages.

SUMMARY OF THE INVENTION

The present invention provides a method and apparatus for introducing conditioning gas into a particulate-containing combustion gas stream. The approach of the invention causes the conditioning gas to be more effectively deposited upon the surface of the particulate, reducing the required retention time. It also permits the conditioning of some types of coals that could not be conditioned by the prior approaches.

The invention provides an approach for conditioning particulate entrained in a flowing gas stream. In accordance with the invention, a method for conditioning a flowing gas stream containing solid particulate matter comprises the steps of furnishing a flowing gas stream containing particulate matter entrained therein; and pretreating the particulate matter of the gas stream, by supplying to the gas stream a conditioning agent, which, when deposited upon the particulate matter, changes the electrical resistivity of the particulate matter, and, substantially simultaneously, establishing an electrostatic potential between the conditioning agent and the particulate of the gas stream at about the location where the conditioning agent is supplied to the gas stream. More specifically, a method for conditioning a flowing gas stream containing fly ash comprises the steps of furnishing a flowing gas stream containing fly ash entrained therein; and pretreating the fly ash of the gas stream, by supplying to the gas stream a conditioning agent selected from the group consisting of a gaseous compound containing sulfur, a gaseous compound containing ammonia, and water vapor, and, substantially simultaneously, establishing an electrostatic potential between the conditioning agent and the fly ash, whereupon the conditioning agent deposits upon the fly ash.

The invention also includes apparatus used in conditioning the gas stream. Apparatus for conditioning a flowing gas stream containing solid particulate comprises means for injecting a conditioning agent into the flowing gas stream; and means for creating an electrostatic potential between the particulate of the flowing gas stream and the injected conditioning agent, at about the point of injection. More specifically, apparatus for conditioning a flowing gas stream containing solid particulate comprises a source of a conditioning agent; a plurality of nozzles that receive conditioning agent from the source and inject it into the flowing gas stream; a plurality of electrodes projecting into the flowing gas stream at locations adjacent the nozzles; and a voltage source that establishes an electrostatic potential between the electrodes and the nozzles.

After the particle-laden gas is conditioned, it is in a suitable state for the removal of the particulate by electrostatic precipitation. In accordance with this aspect of the invention, a method for precipitating solid particulate matter from a flowing gas stream comprises the steps of furnishing a flowing gas stream containing particulate matter entrained therein; pretreating the particulate matter of the gas stream, by supplying to the gas stream a conditioning agent, and, substantially simultaneously, establishing an electrostatic potential between the conditioning agent and the particulate of the gas stream, whereupon the conditioning agent deposits upon the particulate matter to change its electrical conductivity; and electrostatically precipitating the particulate from the conditioned gas stream. The preferred conditioning gas is a gaseous compound containing sulfur, such as sulfur trioxide, a gaseous compound containing ammonia, or water vapor.

In practicing the invention, the conditioning gas is injected into the particle-containing gas stream using at least one, and more usually, a plurality of injection nozzles. A "nozzle" can include any suitable type of injector, such as a probe, a lance, and lateral openings in the sidewalls of a pipe. The conditioning gas is distributed throughout the gas stream, and must be given sufficient residence time to react with ambient water vapor to form sulfuric acid, which then deposits upon the particulate, in the case where the conditioning gas contains sulfur trioxide. That is, in the terminology of the present invention, the term "conditioning agent" is meant to encompass and include solids, liquids and gases. It can include both a reactant injected into the gas stream, and a reaction product of the reactant and some other reactant, which may be produced either in a reaction apart from the particulate or in a reaction upon the surface of the particulate. The preferred conditioning agents are gases that are readily injected into, and mixed with, the flowing gas stream, and the following discussion will be directed primarily toward conditioning gases.

The deposition of the conditioning agent upon the particulate is assisted by the establishment of an electrostatic field in the gas stream, in the region where the injection occurs. The field should cause the molecules of the conditioning agent to be ionized and attracted to the particulate, thereby reducing the residence time required to achieve a selected degree of deposition. The electrostatic field may also cause the conditioning agent to be deposited upon particulate whose surface characteristics would otherwise prevent the conditioning gas molecules ever to deposit upon it, if the electrostatic field were not present.

Preferably, the electrostatic field causes the particulate and the conditioning agent molecules to be oppositely ionized and therefore attracted to each other. Ionization can be accomplished in any acceptable manner, such as the injection of electrons or protons, the establishment of separate high voltage fields that separately ionize the particulate and the conditioning gas, the establishment of a plasma, or the establishment of a single high voltage field, typically of about 4–8 kilovolts per inch separation. The approach is not dependent upon whether either the particulate or the conditioning gas is ionized to a particular state, but normally the particulate is negatively charged and the conditioning gas is positively charged, in the case where the conditioning gas is sulfur trioxide.

The ionization apparatus should be as simple and effective as possible, and also should not be susceptible to becoming inoperable as a result of the deposition of particulate upon it. In a preferred approach, at least one, and usually a plurality, of electrodes are arranged adjacent the nozzles that inject the conditioning agent. The electrodes may be both upstream and downstream of the nozzles, upstream only, downstream only, or at the same location as the nozzles. The electrodes are charged to a high voltage by a power supply, usually a high negative voltage of at least several thousand volts per inch. The nozzles are preferably grounded, or may be oppositely charged. The potential difference between electrodes and the nozzles establishes an electrostatic field around the nozzles.

Particulate matter entering the electrostatic field becomes negatively charged, and conditioning gas molecules ejected from the nozzles become positively charged. The gas molecules move along the lines of force established by the electrostatic field, while the more massive fly ash particles continue their straight line of flight with little alteration. The gas molecules inevitably intercept oppositely charged particulate, and are attracted thereto. When they deposit upon the particulate, the conditioning gas molecules react in the normal manner. After conditioning, the particulate continues to the electrostatic precipitator, where the particulate is removed from the gas stream.

The present approach provides an advance in the conditioning of gas streams such as the combustion gas streams produced by the combustion of low sulfur coal. (The approach is operable more generally to other types of gas streams contained entrained particulate, but in its presently preferred embodiment is used to treat combustion gas streams produced by burning low-sulfur coals.) The enhanced electrostatic conditioning reduces the residence time required to achieve conditioning of the particulate, thereby reducing the size of the apparatus required. The conditioning of certain types of particulate previously very difficult to condition is also possible with this approach. Other features and advantages of the invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 1 is a pictorial representation of the apparatus of the invention; and

FIG. 2 is a side sectional view of the preferred arrangement of the nozzles and electrodes, in the view indicated by the lines 2—2 of FIG. 1.

DETAILED DESCRIPTION OF THE PREFERRED EMBODIMENT

The present invention is preferably embodied in an apparatus 10 for precipitating particulate from a gas stream, such as the combustion gas stream of a coal combustor. In a conventional coal-fired power plant, coal is burned by a combustor 12, and the resulting hot combustion gas is passed through a boiler 14, where it heats and boils water. The resulting steam in a loop 16 flows to a turbine/generator set 18, where electricity for consumption is produced. The steam is condensed, and flows back to the boiler 14 through the other leg of the loop 16.

The combustion gas stream leaving the boiler 14, indicated by numeral 20, cannot normally be exhausted directly to the atmosphere, because it contains the particulate or fly ash resulting from the combustion 12. If it were exhausted to the atmosphere, the fly ash would deposit on everything surrounding the power plant, leaving a thick coating of soot. Fortunately, the fly ash can be removed from the combustion gas 20 by electrostatic precipitator technology, if the fly ash has a sufficiently low electrical resistance.

The fly ash produced by some types of coal, particularly coal containing a low sulfur content, has too high an electrical resistance to be processed efficiently and economically in an electrostatic precipitator, and therefore is desirably conditioned before entering the precipitator. It is known to inject a conditioning gas into the combustion gas stream by a conditioning apparatus 30, illustrated schematically in FIG. 1.

The conditioning apparatus 30 injects a conditioning gas into the combustion gas stream 20. The conditioning gas is preferably sulfur trioxide, but may include, for example, other gases containing sulfur, a gas containing or yielding ammonia, or water vapor. The apparatus 30 therefore includes a source 32 of the conditioning gas, and a plurality of injector nozzles 34 that extend into the combustion gas stream 20 to inject the conditioning gas directly into the stream 20. A preferred source 32 is disclosed in U.S. Pat. No. 3,993,429, and a preferred construction of the nozzles 34 is disclosed in U.S. Pat. No. 4,179,071. The disclosures of both of these patents are incorporated herein by reference.

In the case of injected sulfur trioxide, the injected conditioning gas molecules react with water vapor in the stream 20 to produce sulfuric acid, which deposits upon the particulate in the gas stream to increase the conductivity of the particulate, or, alternatively stated, to lower its resistivity. Other reactions can occur for other injected conditioning gases. For example, if a source of ammonia is injected, the ammonia may react with sulfur in the gas stream to produce ammonium sulfate and ammonium bisulfate. If there is insufficient water vapor in the gas stream to permit the sulfuric acid reaction, water vapor may be injected. The present invention is operable with the injection of these and other types of conditioning gases.

This approach to conditioning combustion gas streams works well with many types of coal, but there are certain types where the injected conditioning gas does not readily react with the particulate. As an example, the surfaces of certain types of particulate are hydrophobic, so that they resist the deposition of the conditioning reactants. Conditioning of such particulate is therefore not possible, or, if possible, takes too long a time or too large a quantity of conditioning gas to be commercially practical. A typical flow rate for the combustion gas stream 20 is about 60 feet per second. In most cases, the conditioning requires a residence time of about 1 second, so that a conditioning residence distance 36 between the conditioning apparatus 30 and an electrostatic precipitator 38 must be at least about 60 feet. If the particulate resists conditioning so that the conditioning residence time increases to 3 seconds, for example, the required distance 36 is increased to an unacceptable 180 feet.

The present invention provides a modification to the conditioning apparatus 30, wherein the apparatus 30 is provided with electrostatic assistance in accomplishing the conditioning of the particulate. A plurality of electrodes 40 extend into the combustion gas stream 20 adjacent the nozzles 34. The electrodes 40 are supported on insulators 42 in the wall 44 of the conduit in which the combustion gas 20 flows. The electrodes 40 are charged to a high negative potential by a power supply 46. The nozzles are at ground, which is positive relative to the electrodes 40.

FIG. 2 illustrates the portion of the apparatus 30 that produces the electrostatic potential in greater detail. Each of the plurality of nozzles 34 include a tubular conduit 48 and a plurality of injector ports 50 on the sides of the conduit 48. The conditioning gas is ejected from the ports 50, and the molecules generally follow paths indicated by the conditioning gas flow pattern 52. This pattern 52 is determined by the electrostatic field between the electrodes 40 and the nozzles 34.

The electrodes 40 are wires or tubes of smaller diameter than the conduits 48, and are preferably placed in a staggered arrangement between the nozzles 34 as viewed transversely to the flow of the combustion gas 20. The electrodes 40 are also displaced from the plane of the nozzles 34 along the direction of the flow of the combustion gas 20. Preferably, some of the electrodes 40 are upstream from the nozzles 40, that is, closer to the boiler 14, and some of the electrodes 40 are downstream from the nozzles 40, that is, closer to the precipitator 38. This is a preferred arrangement of the electrodes in relation to the nozzles, but other arrangements are permitted in other situations where they may yield better performance.

When the electrodes 40 are charged to a high negative potential by the power supply 46, an electrostatic field, indicated by the numeral 54, is established between the electrodes 40 and the nozzles 34. The electrostatic field is established at about the same location (along the gas flow path) and time that the conditioning agent is supplied to the gas stream, or "substantially simultaneously". This field 54 need not necessarily be of the symmetric form indicated in FIG. 2, but is desirably such that substantially all of the combustion gas 20 flowing through the apparatus 30 intercepts part of the field 54. The present electrostatically assisted conditioning cannot be accomplished as to those portions of the combustion gas stream 20 that do not pass through the field 54.

The electrostatic field 54 ionizes both the particulate in the combustion gas stream 20 and the conditioning gas ejected from the nozzles 34, if the voltage between the electrodes 40 and the nozzles 34 is sufficiently high. In normal practice, a voltage difference of about 4–8 kilovolts per inch is sufficient to accomplish the ionization, but the voltage can be varied as necessary for different types of combustion gas streams and different types of coal being burned. In a typical apparatus the electrodes 40 are spaced about 3–4 inches from the nozzles 34, and a voltage difference of about 20,000 volts is applied. It is the voltage difference that is important, and therefore it is acceptable that either the electrodes 40 or the nozzles 34 be at ground potential, and that the other be at the necessary potential. This approach simplifies the construction of the apparatus 30, reducing the number of components that must be electrically isolated. Since the nozzles 34 are connected to the source 32, it is preferable that they be at ground and that the entire potential difference be supplied by making the electrodes 40 negative. However, if a case were encountered where the required voltage difference were too large for the available insulation capacity of the insulators 42 or led to other problems, the nozzles 34 could be electrically biased. As indicated, in the preferred approach the electrodes are negatively charged relative to the nozzles, but they could be positively charged relative to the nozzles in appropriate circumstances.

In the present case, the electrodes 40 are negatively charged by the power supply 46. The power supply is of any acceptable type for delivering a relatively high voltage and low current. Preferably, the power supply 46 includes a high voltage transformer 70 and a full wave rectifier 72 operating from the secondary winding of the transformer. The resulting high voltage is transmitted along wires 74 to the electrodes 40, passing through the walls 44 of the combustion gas duct on the insulators 42.

The particulate entering the electrostatic field 54 from the combustion gas stream 20 becomes negatively charged by the field, and the conditioning gas from the nozzles 34 becomes positively charged, in the normal operation of the apparatus 30. The particulate is large in mass, and its flight path is changed little by the ionizing field 54, so that it continues to flow along its prior path. The ionized gas molecules of the conditioning gas, being much smaller in mass, tend to be deflected and flow along the field lines of the electrostatic field 54, which determine the gas flow pattern 52. The particulate must pass through a widely distributed pattern 56 of the ionized conditioning gas molecules, increasing the chances for an interaction between the two and the deposition of conditioning gas molecules onto the surfaces of the particulate. Additionally, because the particulate and the conditioning gas molecules are oppositely charged, they are attracted together, further increasing the chances that conditioning gas molecules will be deposited upon the particulate.

Either before or when the conditioning gas molecules are deposited upon the surface of the particulate, they react to condition the particulate surfaces to reduce their electrical resistance in the manner previously described. In the case of the preferred sulfur trioxide ($SO_3$) conditioning gas, the sulfur trioxide molecules react with ambient water ($H_2O$) to produce sulfuric acid ($H_2SO_4$), whose presence reduces the resistivity of the particulate. The deposition and chemical reaction take some time, and it is this residence time that necessitates the spacing of the electrostatic precipitator 38 a conditioning distance 36 downstream of the conditioning apparatus 30.

The conditioned combustion gas stream 58 flows from the conditioning apparatus 30 to the electrostatic precipitator 38. The effect of the electrostatic assist to the conditioning, as just described, is to reduce the conditioning distance 36 as compared to what it would otherwise be. In the case of readily conditioned particulate, the conditioning time is reduced from the normal time, thereby shortening the distance 36. In the case of particulate that is difficult or impossible to condition by conventional processes, the distance 36 is reduced to a commercially acceptable amount by using the electrostatic charging approach of the invention.

The particulate is removed from the conditioned gas stream 58 in the electrostatic precipitator 38. The precipitator 38 may be of any of the many types commercially available and known in the art. The precipitator 38 includes a plurality of charged electrodes and grounded collection plates. The particulate in the gas stream 58 is ionized by the field established between the electrodes and the plates, and is attracted to be deposited upon the plates for subsequent removal. Unlike the apparatus 30, the precipitator 38 is designed so that the residence time of the gas stream 58 within the precipitator 38 is sufficiently long that nearly all of the particulate is deposited upon the plates. (The particulate is not deposited in great amounts on the nozzles 34 or electrodes 40 of the apparatus 30 because there is an insufficient time for the path of the ionized particulate to be altered to deposit upon the nozzle structure, and the gas velocity past the nozzles is sufficiently high to blow off any particulate matter which may deposit.)

The resulting cleaned gas stream is exhausted to the atmosphere.

The present invention provides an advance in the art of conditioning combustion gas to improve the removal of particulate. Power plant capital costs can be reduced, and coals that otherwise cannot be used due to their pollution characteristics can now be burned in an environmentally acceptable manner. Although a particular embodiment of the invention has been described in detail for purposes of illustration, various modifications may be made without departing from the spirit and scope of the invention. Accordingly, the invention is not to be limited except as by the appended claims.

What is claimed is:

1. A method for precipitating particulate matter from a flowing gas stream, comprising the steps of: furnishing a flowing gas stream containing particulate matter entrained therein; pretreating the particulate matter of the gas stream, by supplying to the gas stream a conditioning agent selected from the group consisting of sulfur trioxide, a gaseous compound containing ammonia, and water vapor, and substantially simultaneously, establishing an electrostatic potential between the conditioning agent and the particulate matter whereupon the conditioning agent deposits upon the particulate matter; and electrostatically precipitating the particulate matter from the conditioned gas stream.

2. The method of claim 1 wherein the gas stream is a combustion gas stream having residual water therewithin, the conditioning agent is sulfur trioxide, and the step of supplying is accomplished by injecting the conditioning agent into the gas stream and permitting it to react with the residual water therein to form sulfuric acid.

3. The method of claim 1, wherein the conditioning agent is sulfur trioxide.

4. The method of claim 1, wherein the conditioning agent is selected from the group consisting of sulfur trioxide and ammonia.

5. The method of claim 1, wherein the gas stream is a combustion gas stream.

6. The method of claim 5, wherein the gas stream is produced by the combustion of coal.

7. The method of claim 6, wherein the particulate matter is fly ash.

8. The method of claim 1, wherein the particulate matter is charged oppositely relative to the conditioning agent.

9. The method of claim 8 wherein the particulate matter is negatively charged.

* * * * *